US006173908B1

(12) United States Patent
Bureaux et al.

(10) Patent No.: US 6,173,908 B1
(45) Date of Patent: Jan. 16, 2001

(54) AIR ASPIRATING FOAM NOZZLE

(75) Inventors: John G. Bureaux, Orleans; George Cowan, Burnstown, both of (CA)

(73) Assignee: Her Majesty the Queen in right of Canada, as represented by the Solicitor General actions through the Commissions RCMP

( * ) Notice: Under 35 U.S.C. 154(b), the term of this patent shall be extended for 0 days.

(21) Appl. No.: 09/308,836

(22) PCT Filed: Nov. 27, 1997

(86) PCT No.: PCT/CA97/00912

§ 371 Date: Aug. 13, 1999

§ 102(e) Date: Aug. 13, 1999

(87) PCT Pub. No.: WO98/23331

PCT Pub. Date: Jun. 4, 1998

Related U.S. Application Data

(63) Continuation-in-part of application No. 08/758,075, filed on Nov. 27, 1996, now abandoned.

(51) Int. Cl.[7] ..... B05B 7/30

(52) U.S. Cl. ..... 239/428.5; 239/590.3; 239/DIG. 23

(58) Field of Search ..... 239/DIG. 23, 432, 239/343, 428.5, 495, 590.3

(56) References Cited

U.S. PATENT DOCUMENTS 3,388,868 * 6/1968 Watson ..... 239/488.5 X
3,424,250 * 1/1969 Thomae .
4,925,109 * 5/1990 Flanagan ..... 239/429

FOREIGN PATENT DOCUMENTS

842461 * 7/1960 (GB) ..... 239/428.5

* cited by examiner

*Primary Examiner*—Kevin Weldon
(74) *Attorney, Agent, or Firm*—J. Wayne Anderson

(57) ABSTRACT

A foam generating nozzle is disclosed comprising a cylindrical housing, a first inlet at one end of the housing for connection to a supply of foamable liquid under pressure, a second inlet at the first end for air supply, a foam discharge outlet at the other end of the housing, a diffuser associated with the first inlet and a conical screen of a non-corrosive material disposed in said housing between the ends with its apex directed toward the discharge outlet, to provide a screen surface area larger than the inlet air supply area, such that in operation the foamable liquid is sprayed onto the screen by the diffuser in a pattern which matches the conical shape of the screen, while air is dragged through the screen thereby generating the foam.

13 Claims, 2 Drawing Sheets

AIR ASPIRATING FOAM NOZZLE

This application is the U.S. National Stage of International Application PCT/CA97/00912 filed Nov. 27, 1997 which is a continuation-in-part of U.S. application Ser. No. 08/758,075 filed Nov. 27, 1996 now abandoned.

BACKGROUND OF THE INVENTION

1. Field of the Invention

This invention relates to foam delivery systems, and in particular to a foam generating nozzle assembly for use in such systems.

2. Description of the Prior Art

It is known in the prior art to employ expansive foam in fire fighting. Typically such foams are formed from water-soluble surfactants of the perfluorocarbon type which may be dispensed from a variety of different types of equipment, all well known in the art. One such typical material is known in the art as AFFF, see U.S. Pat. Nos. 3,258,423; 3,562,156 and 3,772,195, for example. Generically these materials are also known as FCS and HCS materials, e.g., fluorocarbon surfactants and hydrocarbon surfactants. Variations include those AFFF compositions which include a fluoro-chemical synergist known as F-amide and an FCS called F-AMPS, see for example U.S. Pat. Nos. 4,090,367 and 4,014,926. These foam producing materials are known to produce high-expansion foams which are known to spread over the surface in order to suppress vaporization of gasoline, which is the principal reason these materials were developed. Other patents which disclose similar materials are U.S. Pat. Nos. 4,442,018 and 4,770,794.

Foams from the above and other equivalent materials tend to be of small envelope or bubble size and flowable, the latter being one of the desirable qualities for use in fighting fires. Moreover, the foams may be formed relatively easily at the site of application by any number of different devices, all well known in the art. Portable units of various sizes as well as truck mounted units are commercially available for forming and dispensing various amounts of foamed material. For example, units are available which dispense from 2,000 to 15,000 or more cubic feet of foam per minute. Dispensing units include water reaction motors, electrically powered units, turbine units, compressed gas driven units and the like. Some of the dispensing equipment includes a tubular member which may be from two feet to ten feet in diameter, connected to the foam generator, and used to control the direction of foam discharge. The foam is discharged from the open end to the tubular member remote from the foam generator. The result is that an enormous amount of foam may be quickly dispensed from a relatively small unit in a relatively short time using a relatively small amount of water and foaming agent. Since the foam includes a surfactant, it tends to flow easily and spread quickly over the contact surfaces which it readily wets. Such foams may also be dispensed from high velocity nozzles and projected a relatively long distance and with sufficient accuracy to reach a designated target area.

Typically, the foams above described are sometimes referred to as expanded foams, having an expansion ratio of 50 to 1 to 1000 to 1. These types of foams do not have sufficient strength to remain in a three-dimensional shape, for example, a mound, for any significant length of time. The foams described, dispensed by known equipment and techniques, tend to have a relatively long life since collapse of the foam is due principally to evaporation of the water component of the foam. Thus in the absence of heat or flame, the foam tends to remain fairly stable for a relatively long period. However, it is also true that the foam tends to spread laterally rather quickly since this is one of the desirable features in its use as a fire fighting material.

It is also known in the prior art to use such foams in blast suppression e.g. to disrupt improvised explosive devices (IED's) specifically in U.S. Pat. No. 4,589,341, a blast suppression method is provided through the use of foams heretofore used in fire fighting and wherein the formed foam is confined in such a way as to control the continued propagation of the blast wave, thereby absorbing the compression wave in all radial directions or selectively absorbing the blast wave so that its continued propagation in any given direction is suppressed.

Class A foams are used for cellulose-based fires, and Class B foams are used to combat flammable liquid fires.

It is also known to generate foam by spraying a foamable liquid onto a perforated metal screen, while blowing air through the screen. See U.S. Pat. No. 3,723,340.

Also, a plurality of spaced horizontal sieves are employed in the foam dispenser nozzle disclosed in U.S. Pat. No. 5,064,103. The sieves have different sized openings, decreasing in size toward the discharge orifice.

SUMMARY OF THE INVENTION

According to the invention, a foam generating nozzle assembly is provided comprising a cylindrical housing, a first inlet at one end of the housing for connection to a supply of foamable liquid under pressure, a second inlet at the first end for air supply, a foam discharge outlet at the other end of the housing, a diffuser associated with the first inlet and a conical screen of a non-corrosive material disposed in said housing between the ends with its apex directed toward the discharge outlet, to provide a screen surface area larger than the inlet air supply area, such that in operation the foamable liquid is sprayed onto the screen in a conical pattern, while air is dragged through the screen, thereby generating the foam.

DESCRIPTION OF THE PREFERRED EMBODIMENT(S)

Figure 1:
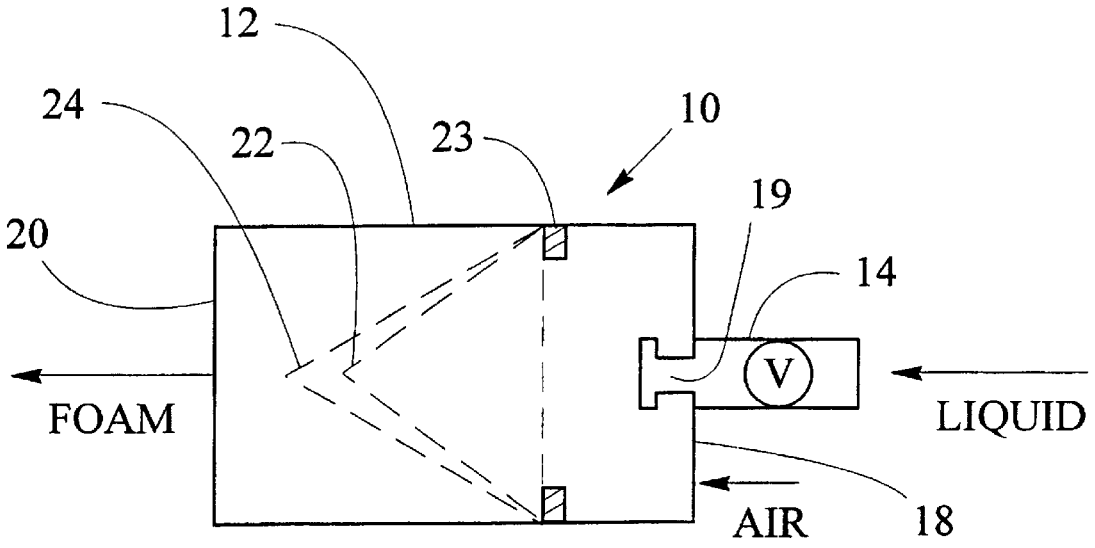
FIG. 1 is a side elevation, partly in section, of a foam generating nozzle assembly according to one embodiment of the invention.

One embodiment of a nozzle assembly 10 according to the invention is shown in FIG. 1, as comprising a cylindrical housing 12. A first inlet 14 is provided at one end for connection to a supply of foamable liquid under pressure(not shown). The first inlet includes a flow control valve V, for example, a quarter turn ball valve. A diffuser means 19 e.g. in the form of a screen is provided at the first inlet to project the foamable liquid in the form of a spray. Eg. Scotty Model #4037 Fog Nozzle. The diffuser projects and focuses the spray on the screen in a conical pattern which matches the screen shape. A second inlet 16 is also provided at this end of the housing to provide an air supply. A foam discharge outlet 20 is provided at the other end of the housing. A first conical screen 22 is disposed in the housing between the ends, with its apex directed toward the discharge opening and the periphery of its base touches the inner diameter of the housing. An attachment means 23 is provided to attach the screen to the housing. For example, a securing ring is bolted through the housing, and the screen is spot-welded to the ring. A second conical screen 24 of larger surface area is stacked on top of the first screen.

Preferably, the conical spray pattern is adjusted to strike the first screen 22 adjacent to the periphery of its base.

It will be appreciated that foam bubbles are formed on the first screen by the combination of spraying of the foamable liquid against the first screen, while air is dragged through the screen.

Figure 2:
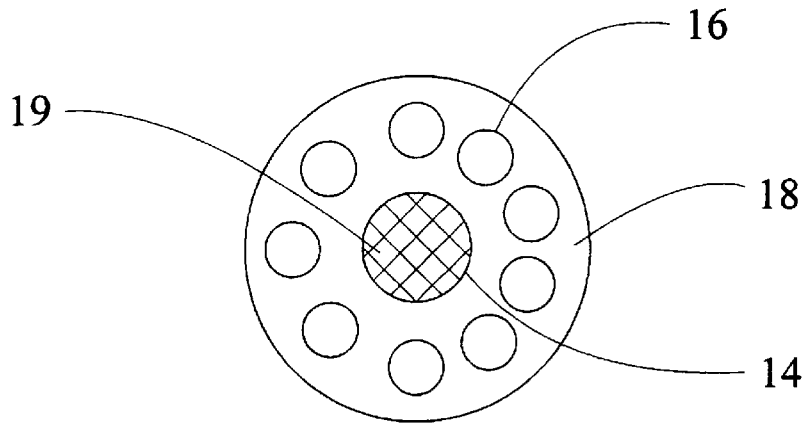
FIG. 2 is an end view of the inlet end of the nozzle according to the invention.

As best seen in FIG. 2, the second inlet is in the form of a plurality of peripheral openings 16 in an end closure disc 18.

Figure 3:
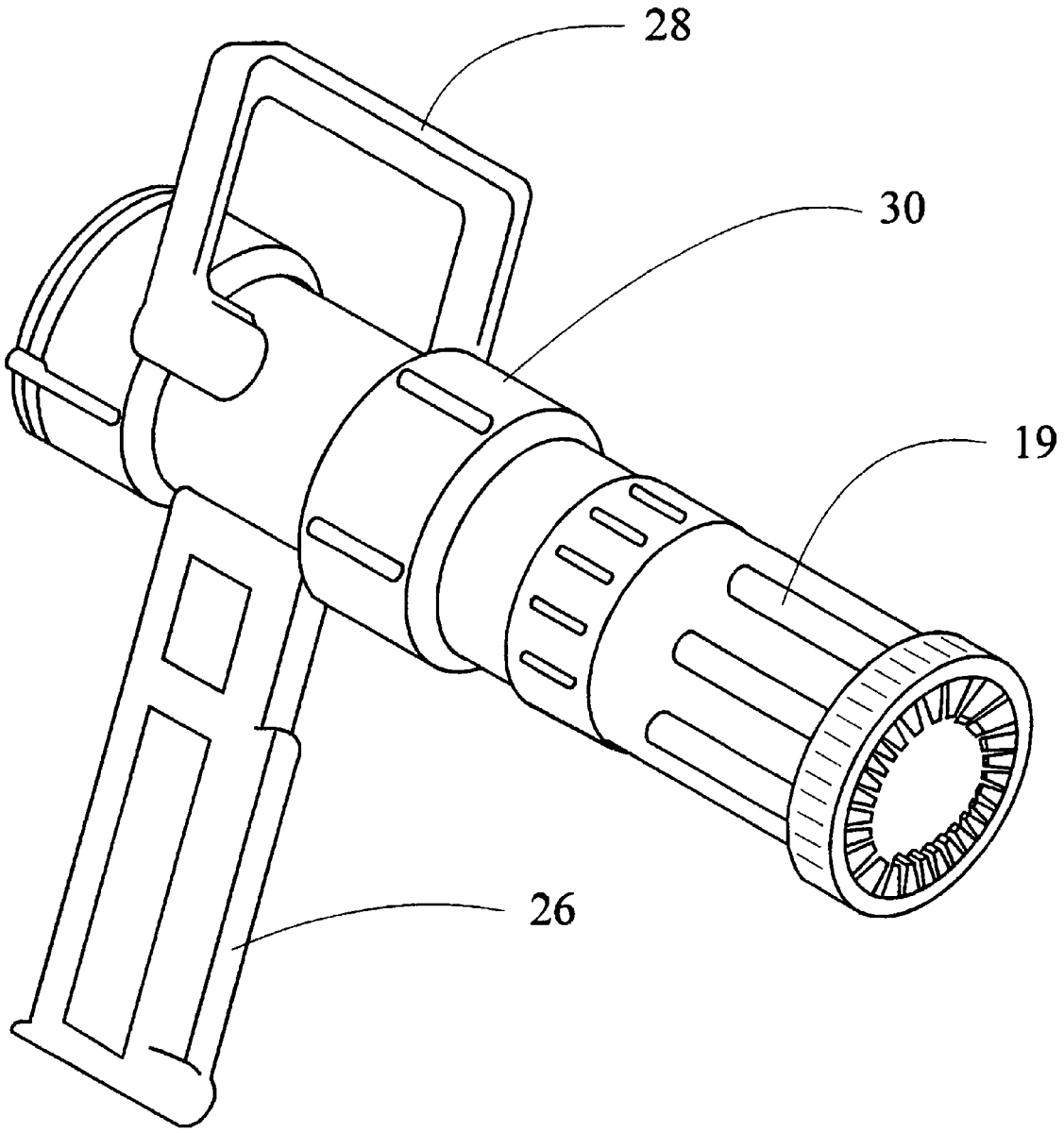
FIG. 3 is a side elevation, in perspective, of part of the nozzle assembly according to another embodiment of the invention.

FIG. 3 illustrates the details of the shut-off valve and diffuser portion of the nozzle according to the invention.

Specifically, a pistol grip 26 is provided to facilitate direction of the foam. A standard D-handle on-off valve 28 is also provided to initiate and stop the foam delivery. The diffuser 19 is also shown as the Scotty™ Model #4037, including adjustment means for adjusting the conical spray pattern. A standard survival fitting 30 is also shown.

The nozzle housing can be made from various non-corrosive materials such as ABS, but the screen must be made of a non-corrosive material such as stainless steel. In a preferred embodiment, the housing length is 25 cm and the diameter is 15 cm. The following parameters are for this embodiment. Larger units can be made having proportional dimensions and parameters.

The conical shape of the first screen allows the surface area of the screen to be larger than the inlet air supply area of the housing. This provides for an increased development of foam bubbles. Preferably, the surface area of the first screen is about 105 inches$^2$, which makes it about 11 times the air inlet supply area. The surface area is associated with cone angle e.g. 35–70°, preferably about 60°.

The screen size is selected for reliability of reproducible bubble structure and durability. a size range of 15–20 Mesh is contemplated. The preferred screen for this embodiment is Screen Mesh 20, which includes 20 strands/inch, with a wire gauge of 12,000.

The flow rate of the foamable liquid is preferably about 1 US gallon/minute/inch$^2$ of screen surface area, at a pressure of about 70 psi. This provides for a foam expansion rate of 15 to 30:1, corresponding to 1 to 3%/w of active ingredient in water.

The second conical screen has a larger surface area than that of the first i.e. about 112 inches$^2$. Otherwise, the two screens can be the same mesh size. However, in view of the scrubbing action of the 2nd screen, it can be that the first screen is of somewhat larger mesh size. The screens are stacked such that their apices are spaced 0.5–2, preferably about 1.5 inches apart.

The second screen acts as a scrubber, which refines the bubble structure, making it more uniform, and the additional scrubbing improves the drainage rate of the foam bubble.

Although it will be appreciated that the second screen is not essential and bubbles can be generated using a single screen, each additional screen (more than one) improves the drain rate of the bubble structure, which is important for stability and longevity of the bubble. That is, the faster the drainage rate, the quicker the bubble self-destructs. The slower the drain rate, the longer and more durable the foam bubble. This is important for blast suppression to resist the concussion of the detonation. This also increases the drag on objects propelled as a result of the explosion.

The foamable liquid used is typically in the form of a foam concentrate comprising as active ingredients a composition of surfactants, solvents, foam stabilizers and salts, the balance being water. For example, the foam formulation described in U.S. Pat. No. 4,770,794 has been found useful to suppress explosions, and is amenable to mixture with some known decontaminants. This foam formulation is sold under the trademark Silvex. For chemical decontamination uses, decontaminants are also included as active ingredients, and the composition must be compatible with the decontamination formulation used. Also, it has been found that when the decontaminant is added, the foam expansion ratio is lowered into the range of 12–17:1, which maintains good stability and drainage properties.

What is claimed is:

1. A foam generating nozzle assembly (10), comprising a cylindrical housing (12) having an inner diameter, a first inlet (14) at a first end of the housing connected to a supply of foamable liquid under pressure, a second inlet (16) at the first end for providing an air supply area, a foam discharge outlet (20) at the other end of the housing, a conical screen (22) of a non-corrosive material providing a foam-forming surface and being disposed in said housing between the ends, the screen having a base and an apex with the apex directed toward the discharge outlet and the base touching the inner diameter of the housing, to provide a screen surface area larger than the inlet supply area, and a diffuser (19) associated with the first inlet (14) for spraying the foamable liquid onto the screen (22) in a conical spray pattern, and means associated with the diffuser (19) for adjusting the conical spray pattern to strike the screen adjacent to the base, wherein the foamable liquid is supplied at a flow rate of about 1 US gallon/minute/inch$^2$ of screen surface area, at a pressure of about 70 psi, and wherein the foam produced is of an expansion ratio of 15–30:1, such that in operation the foamable liquid is sprayed onto the screen (22) while air is dragged through the screen (22) thereby generating the foam on the screen surface (22).

2. A nozzle according to claim 1, wherein the screen (22) has a surface area which is about eleven times the surface area of the air inlet (16).

3. A nozzle according to claim 2, wherein the surface area of the screen (22) is about 105 inches$^2$.

4. A nozzle according to claim 2, wherein the screen (22) has a cone angle of 35–70°.

5. A nozzle according to claim 4, wherein the cone angle is about 60°.

6. A nozzle according to claim 5, wherein the screen (22) is of mesh size 15–20.

7. A nozzle according to claim 6, wherein the screen (22) is of mesh size 20.

8. A nozzle according to claim 1, wherein the screen (22) is made of stainless steel.

9. A nozzle according to claim 1, additionally comprising a second conical screen (24) of a non-corrosive material having a surface area larger than that of the first screen (22) disposed in the housing in stacked relationship with the first screen (22).

10. A nozzle according to claim 9, wherein the surface area of the second screen (24) is about 112 inches$^2$.

11. A nozzle according to claim 10, wherein the second screen (24) has an acute cone angle larger than that of the first screen (22).

12. A nozzle according to claim 11, wherein the screen (22, 24) apices are spaced about 1.5 inches apart.

13. A nozzle according to claim 12, wherein the second screen (24) is made of stainless steel.

* * * * *